US005507885A

United States Patent [19]

Sakai et al.

[11] Patent Number: 5,507,885

[45] Date of Patent: Apr. 16, 1996

[54] COPPER-BASED ALLOY

[75] Inventors: Sadao Sakai, Kamiinagun; Setsuo Kaneko, Chino; Kazuaki Yajima, Suwa; Kazuhiko Kobayashi, Chino, all of Japan

[73] Assignee: Kitz Corporation, Chiba, Japan

[21] Appl. No.: 357,932

[22] Filed: Dec. 16, 1994

[30] Foreign Application Priority Data

Jan. 17, 1994 [JP] Japan ..... 6-015742
Jan. 17, 1994 [JP] Japan ..... 6-015743

[51] Int. Cl.[6] ..... C22C 9/04

[52] U.S. Cl. ..... 148/434; 148/433; 148/435; 420/481; 420/475; 420/476; 420/485; 420/491; 420/492; 420/499

[58] Field of Search ..... 148/434, 414, 148/433, 435; 420/477, 481, 485, 491, 492, 499, 475, 476

[56] References Cited

U.S. PATENT DOCUMENTS

| | | | |
|---|---|---|---|
| Re. 19,915 | 4/1936 | Freeman, Jr. . | |
| 2,061,921 | 11/1936 | Roath | 138/47 |
| 3,963,526 | 6/1976 | Lunn | 148/2 |
| 4,101,317 | 7/1978 | Okano | 75/156.5 |
| 4,417,929 | 11/1983 | Tomaru | 148/433 |
| 4,995,924 | 2/1991 | Akutsu et al. | 148/433 |

FOREIGN PATENT DOCUMENTS

| | | | |
|---|---|---|---|
| 53-56126 | 5/1978 | Japan . | |
| 55-97443 | 7/1980 | Japan | 420/477 |
| 57-73150 | 5/1982 | Japan | 148/434 |
| 57-76143 | 5/1982 | Japan | 148/434 |
| 58-38500 | 8/1983 | Japan . | |
| 63-9573 | 2/1984 | Japan . | |
| 59-126741 | 7/1984 | Japan | 148/434 |
| 59-118841 | 7/1984 | Japan | 148/434 |

*Primary Examiner*—John Sheehan
*Attorney, Agent, or Firm*—Wenderoth, Lind & Ponack

[57] ABSTRACT

A copper-based alloy, viz. a dezincification-resistant brass, excels in various properties such as resistance to dezincification, hot forgeability and machinability and, therefore, tolerates use particularly in the atmosphere of a corrosive aqueous solution. The brass of one species has a composition of 59.0 to 62.0 wt % of Cu, 0.5 to 4.5 wt % of Pb, 0.05 to 0.25 wt % of P, 0.5 to 2.0 wt % of Sn, 0.05 to 0.30 wt % of Ni, with or without 0.02 to 0.15 wt % of Ti, and the balance of Zn and unavoidable impurities. The brass of another species has a composition of 61.0 to 63.0 wt % of Cu, 2.0 to 4.5 wt % of Pb, 0.05 to 0.25 wt % of P, 0.05 to 0.30 wt % of Ni, with or without 0.02 to 0.15 wt % of Ti, and the balance of Zn and unavoidable impurities.

22 Claims, 8 Drawing Sheets

COPPER-BASED ALLOY

BACKGROUND OF THE INVENTION

1. Field of the Invention

This invention relates to a copper-based alloy and more particularly to a dezincification-resistant brass which excels in various properties, such as resistance to dezincification, hot forgeability and machinability and, therefore, tolerates use particularly in the atmosphere of a corrosive aqueous solution.

2. Description of the Prior Art

Generally, Pb-containing brass is adapted for extensive use by its excellent quality manifested in hot forgeability arid machinability. It nevertheless is at a disadvantage in yielding to dezincification in the atmosphere of a corrosive aqueous solution. On account of this disadvantage, it is used for only limited purposes.

Some of the species of dezincification-resistant brass which have been in use to date fail to manifest satisfactory resistance to dezincification and others face various tasks such as seeking virgin formulation necessitating use of expensive raw materials for the sake of decreasing to the fullest possible extent the amount of impurities unavoidably contained in the produced alloy by reason of the technical standard.

This invention has been developed in association with the tasks mentioned above. It has for its object the provision of a copper-based alloy which excels in various properties such as resistance to dezincification, hot forgeability and machinability.

SUMMARY OF THE INVENTION

To accomplish the object described above, the first aspect of this invention resides in a copper-based alloy having a composition of 59.0 to 62.0 wt % of Cu, 0.5 to 4.5 wt % of Pb, 0.05 to 0.25 wt % of P, 0.5 to 2.0 wt % of Sn, 0.05 to 0.30 wt % of Ni, and the balance of Zn and unavoidable impurities.

The second aspect of this invention resides in a copper-based alloy having a composition of 59.0 to 62.0 wt % of Cu, 0.5 to 4.5 of Pb, 0.05 to 0.25 wt % of P, 0.5 to 2.0 wt % of Sn, 0.05 to 0.30 wt % of Ni, 0.02 to 0.15 wt % of Ti, and the balance of Zn and unavoidable impurities and having the $\alpha+\beta$ structure finely divided uniformly.

The third aspect of this invention resides in a copper-based alloy having a composition of 61.0 to 63.0 wt % of Cu, 2.0 to 4.5 wt % of Pb, 0.05 to 0.25 wt % of P, 0.05 to 0.30 wt % of Ni, and the balance of Zn and unavoidable impurities.

The fourth aspect of this invention resides in a copper-based alloy having a composition of 61.0 to 63.0 wt % of Cu, 2.0 to 4.5 wt % of Pb, 0.05 to 0.25 wt % of P, 0.05 to 0.30 wt % of Ni, 0.02 to 0.15 wt % of Ti, and the balance of Zn and unavoidable impurities.

The invention will be better understood and the objects and features thereof other than those set forth above will become apparent from the detailed description-thereof given below with reference to the accompanying drawings.

DETAILED DESCRIPTION OF THE PREFERRED EMBODIMENTS

Figure 1:
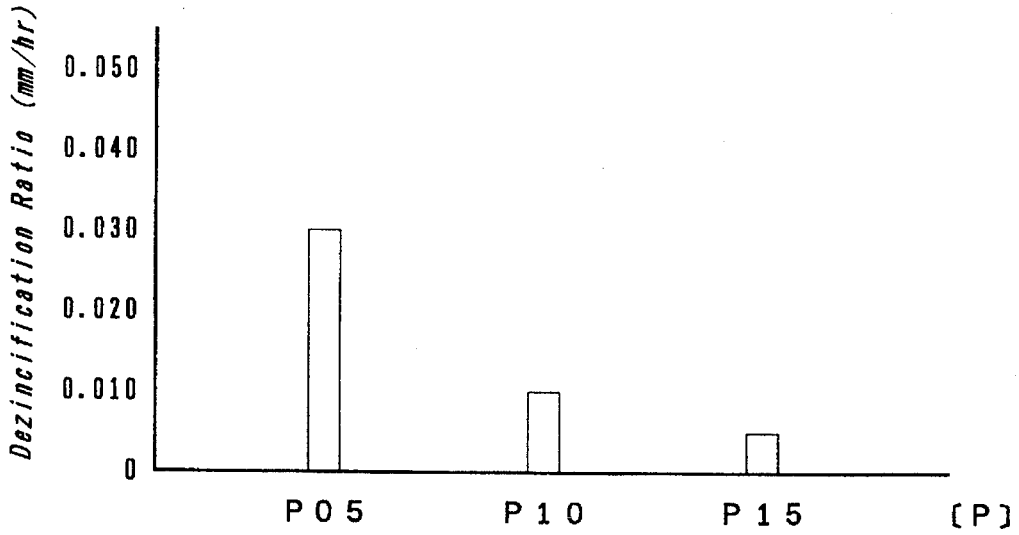
FIG. 1 PRIOR ART
FIG. 1 is a graph showing the relation between the contents of P in conventional copper-based alloys shown in Table 1 and the dezincification ratios of the alloys.

The ranges of composition of copper-based alloys according to this invention mentioned above and the reasons therefor will be specifically described below.

Cu: The resistance to dezincification improves in proportion as the content of Cu increases. Since Cu has a higher unit price than Zn, it is necessary that the Cu content be repressed to a low level. In connection with the content of P, i.e. an element incorporated for the purpose of improving the resistance to dezincification as will be specifically described afterward, the content of Cu for offering satisfactory resistance to dezincification is specified by the first and second aspects of this invention to be in the range of from 59.0 to 62.0 wt %, preferably from 60.5 to 61.5 wt %, so as to impart improved hot forgeability to the produced alloy. The third and fourth aspects of this invention specify the Cu content to be in the range of from 61.0 to 63.0 wt %, preferably from 62.2 to 62.6 wt %.

Pb: The copper-based alloy of this invention incorporates Pb therein for the purpose of acquiring improved machinability. If the content of Pb is not more than 0.5 wt %, the produced alloy will be deficient in machinability. Conversely, if this content is unduly large, the produced alloy betrays deficiency in tensile strength, elongation and impact strength. The first and second aspects of this invention specify the content of Pb to be in the range of from 0.5 to 4.5 wt %, preferably 1.6 to 2.4 wt %. The third and fourth aspects of this invention specify the content of Pb to be in the range of from 2.0 to 4.5 wt %, preferably 2.1 to 4.2 wt %.

P: The alloy of this invention incorporates P therein for the purpose of acquiring improved resistance to dezincification. Indeed the resistance to dezincification improves in proportion as the content of P increases as shown in FIG. 1 and Table 1 below. Since part of the incorporated P is destined to persist as a hard and brittle $Cu_3P$ phase in the produced alloy, it is necessary that the P content be repressed to a low level. The first and second aspects of this invention, therefore, specify the content of P for exhibiting satisfactory resistance to dezincification without adversely affecting hot forgeability to be in the range of from 0.05 to 0.25 wt %, preferably from 0.07 to 0.10 wt %. The third and fourth aspects of the invention specify the content of P to be in the range of from 0.05 to 0.25 wt %, preferably from 0.07 to 0.2 wt %.

TABLE 1

| | Composition (wt %) | | | | | |
|---|---|---|---|---|---|---|
| Sample No. | Cu | Pb | P | Ni | Ti | Zn |
| P05 | 61.9 | 2.3 | 0.05 | — | — | Balance |
| P10 | 62.0 | 2.2 | 0.11 | 0.10 | — | Balance |
| P15 | 62.0 | 2.3 | 0.15 | 0.11 | 0.07 | Balance |

The samples indicated in Table 1 were cast samples having Cu, Pb, Ni, Ti, and Zn contained therein in approximately fixed amounts. The test for dezincification was carried out in accordance with the ISO-6509 method, with the necessary modifications.

Figure 2:
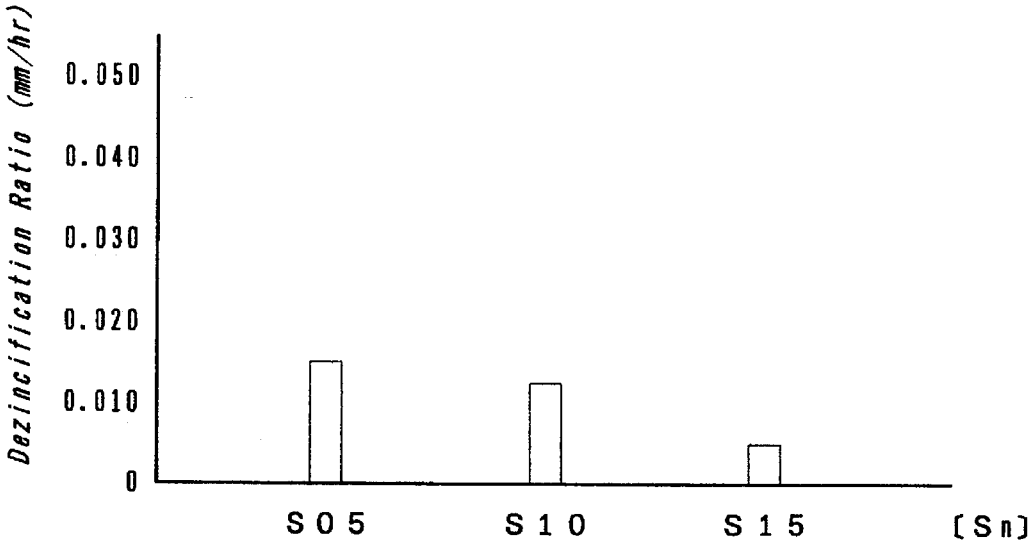
FIG. 2 PRIOR ART
FIG. 2 is a graph showing the relation between the contents of Sn in conventional copper-based alloys shown in Table 2 and the dezincification ratios of the alloys.

Sn: The alloys of the first and second aspects of this invention incorporate Sn therein for the purpose of acquiring improved resistance to dezincification. Indeed the resistance to dezincification is improved in proportion as the Sn content is increased as shown in FIG. 2 and Table 2 below. Since Sn has a higher unit price than Zn, however, it is necessary that the Sn content be repressed to the fullest possible extent for the purpose of keeping down the cost of raw material. In association with Cu and P, i.e. elements which repress the dezincification, the content of Sn for most favorably exhibiting resistance to dezincification is specified by the first and second aspects of the invention to be in the range of from 0.5 to 2.0 wt %, preferably from 1.0 to 1.5 wt %.

TABLE 2

| | Composition (wt %) | | | | | |
|---|---|---|---|---|---|---|
| Sample No. | Cu | Pb | P | Ni | Ti | Zn |
| S05 | 62.3 | 2.3 | 0.47 | — | — | Balance |
| S10 | 62.2 | 2.3 | 1.03 | 0.12 | — | Balance |
| S15 | 62.3 | 2.4 | 1.49 | 0.11 | 0.07 | Balance |

The samples indicated in Table 2 were cast samples having Cu, Pb, Ni, Ti, and Zn contained therein in approximately fixed amounts. The test for dezincification was carried out in accordance with the ISO method mentioned above.

Ni: Ni, when incorporated at all in the alloy, manifests an effect of directly resisting dezincification. It is meanwhile capable of finely dividing the structure of the alloy in the form of an ingot and uniformizing the fine division of the a $\alpha+\beta$ phase. After the alloy undergoes the subsequent process steps such as extrusion and casting, the Ni is finely dispersed uniformly in the alloy and enabled to offer effective resistance to dezincification. The first and second aspects of this invention, therefore, specify the content of Ni to be in the range of from 0.05 to 0.30 wt %, preferably 0.05 to 0.10 wt %. The third and fourth aspects of the invention specify the content of Ni to be in the range of from 0.05 to 0.30 wt %, preferably from 0.05 to 0.15 wt %.

Ti: The alloys of the second and fourth aspects of the invention incorporate Ti therein for the purpose of enabling Ni to cooperate synergistically with Ti to promote the effect of finely dividing uniformly the $\beta$ phase. The second aspect of this invention specifies the content of Ti to be in the range of from 0.02 to 0.15 wt %. The fourth aspect of the invention specifies the content of Ti to be in the range of from 0.02 to 0.15 wt %. Preferably the amount of Ti in the second and fourth aspects is from 0.02 to 0.08 wt %.

Figure 3:
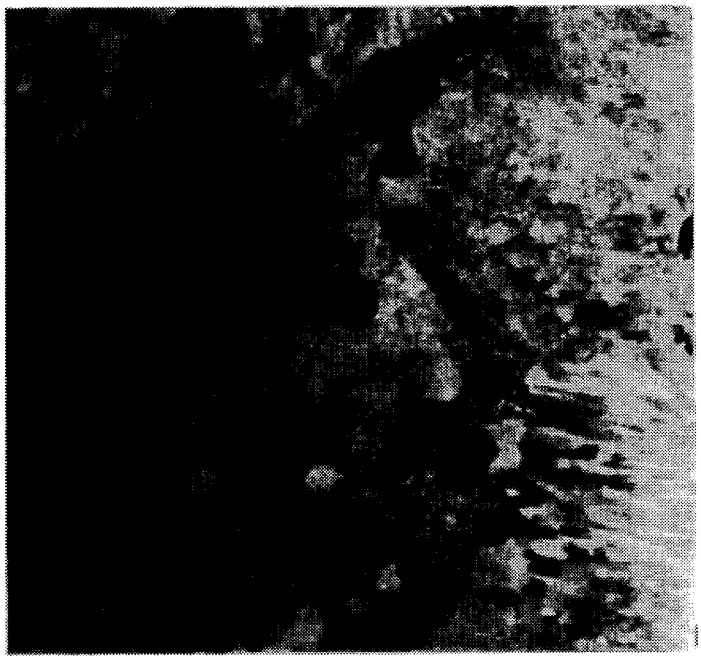
FIG. 3 PRIOR ART
FIG. 3 is a photomicrograph (×200) of the structure of an ingot of a conventional hot forging grade brass [Japanese Industrial Standard (JIS) C3771].
Figure 4:
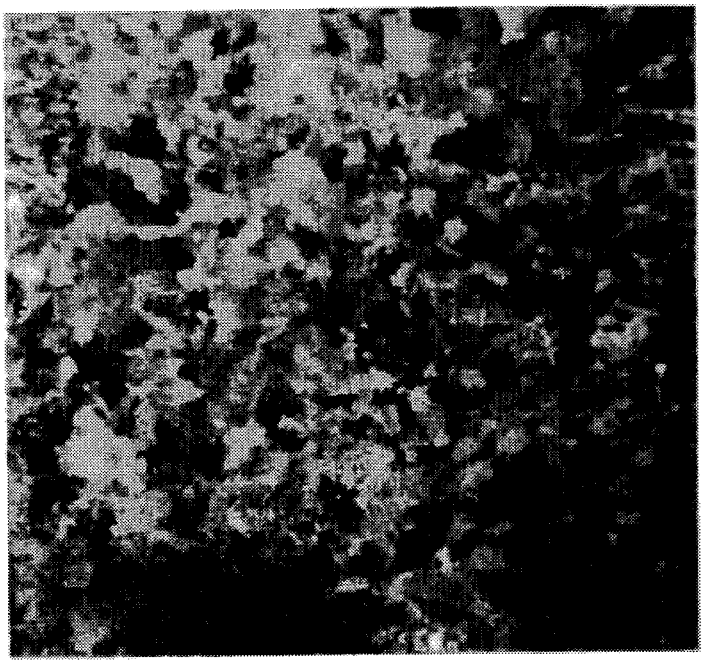
FIG. 4 is a photomicrograph showing the structure of an ingot of a copper-based alloy according to the first aspect of this invention.
Figure 5:
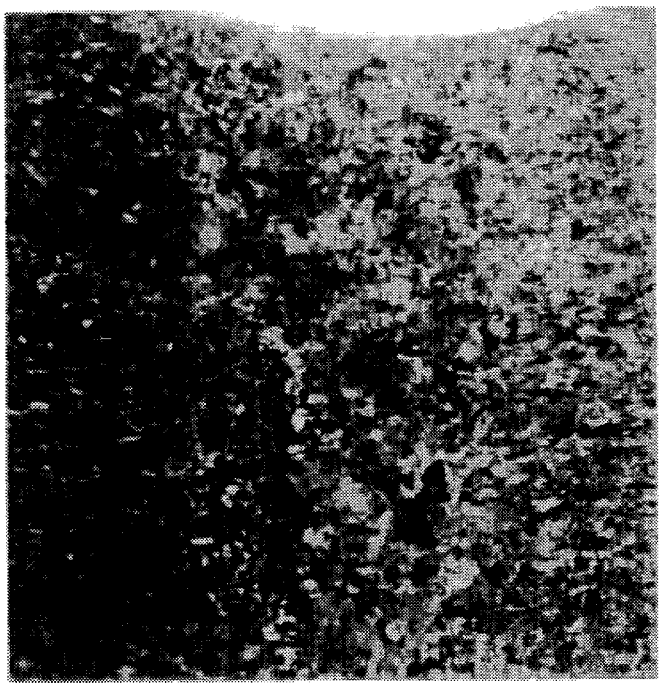
FIG. 5 is a photomicrograph showing the structure of an ingot of a copper-based alloy according to the second aspect of this invention.

The fine division of the structure of an ingot caused by the incorporation of Ni and Ti is demonstrated in photomicrographs. FIG. 3 is a photomicrograph of the structure of an ingot of a conventional brass of JIS C3771 and FIG. 4 a photomicrograph of the structure of an ingot of a copper-based alloy according to the first aspect of the invention and containing 60.5 wt % of Cu, 2.1 wt % of Pb, 0.10 wt % of P, 1.2 wt % of Sn and 0.12 wt % of Ni. FIG. 5 is a photomicrograph of the structure of an ingot of a copper-based alloy according to the second aspect of the invention and containing 60.5 wt % of Cu, 2.1 wt % of Pb, 0.10 wt % of P, 1.2 wt % of Sn, 0.20 wt % of Ni and 0.06 wt % of Ti.

Figure 6:
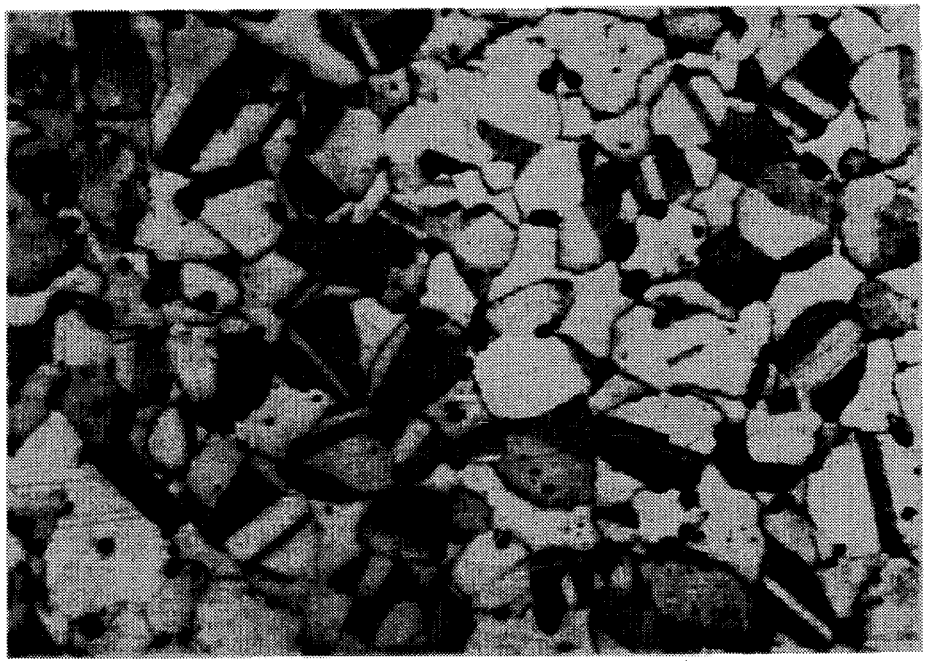
FIG. 6 PRIOR ART
FIG. 6 is a photomicrograph (×300) of the microstructure of a conventional hot forging grade brass (JIS C3771).
Figure 7:
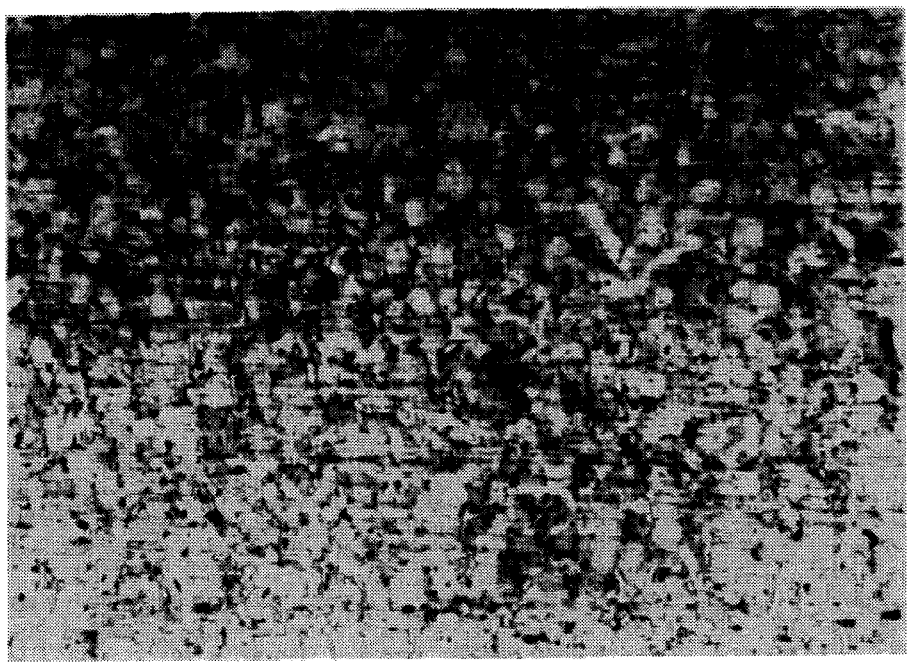
FIG. 7 is a photomicrograph (×200) of the microstructure of a copper-based alloy according to the first aspect of this invention.
Figure 8:
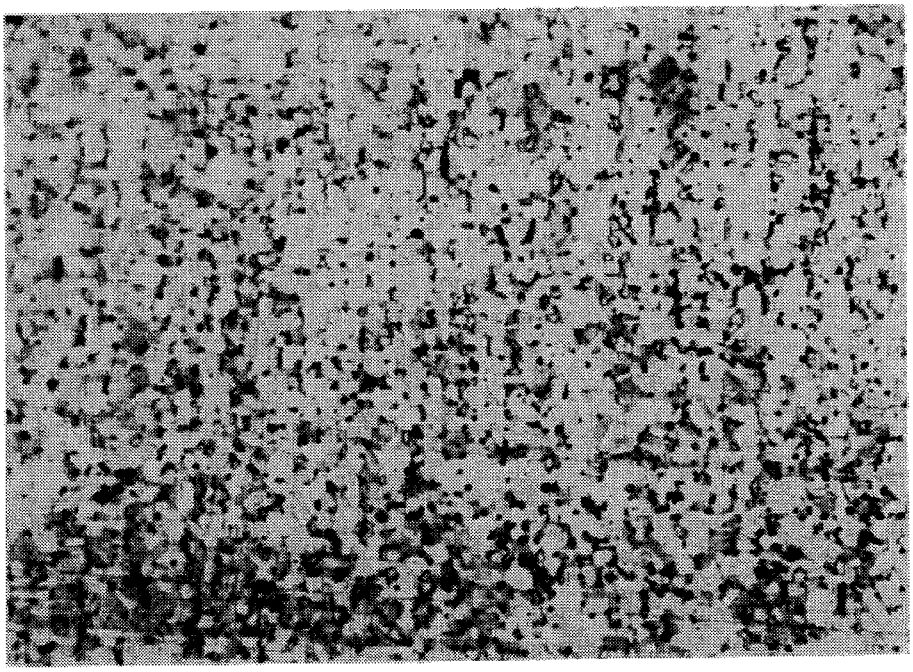
FIG. 8 is a photomicrograph (×200) of the microstructure of a copper-based alloy according to the second aspect of this invention.

FIG. 6 is a photomicrograph (×300) of the microstructure of a conventional alloy of JIS C3771, FIG. 7 is a photomicrograph (×200) of the microstructure of the alloy of the first aspect of this invention, and FIG. 8 is a photomicrograph (×200) of the microstructure of the alloy of the second aspect of this invention.

The unavoidable impurities which are contained in the alloy by reason of the technical standard include Fe, for example. The alloy of this invention tolerates the presence of these unavoidable impurities so long as the total content thereof is confined within 0.8 wt %. This upper limit generally falls in the range specified by JIS. So long as the alloy is manufactured by following the procedure generally adopted for the production of brass, this upper limit can be fulfilled without requiring any special measure. The observance of this upper limit contributes also to repress the cost of raw material to a low level.

The alloy of this invention is produced, for example, by a method which comprises preparing a billet of alloy having the composition mentioned above, subjecting the billet to extrusion, drawing and hot forging at a temperature of 700° C., and heat-treating the drawn forged rod for thorough removal of internal stress from the product.

Working examples of the use of the copper-based alloy of this invention will be described below.

First, the working examples of the first and second aspects of this invention will be cited together with test examples and comparative examples below. In these working examples, hot forging grade dezincification-resistant brass materials which excel particularly in resistance to corrosion and in hot forgeability as well can be obtained as demonstrated hereinbelow.

Table 3 shows the results of a test for hot forgeability and a test for dezincification. The samples indicated therein were invariably produced by the aforementioned known method, specifically by extruding a billet 250 mm in diameter into a rod 24 mm in diameter at an extrusion temperature of 700° C., drawing this rod at a cross section-decreasing ratio of 10% and hot forging the drawn rod at a temperature of 720° C. The samples were observed under a stereomicroscope at 10 magnifications to determine their respective hot forgeability. The hot forgeability was evaluated in comparison with a standard hot forging grade brass material (Sample No. 1) conforming to JIS C3771 and rated on the two-point scale, wherein the mark "○" stands for hot forgeability equal to that of the standard and the mark "X" for hot forgeability inferior to that of the standard.

The samples obtained after the forging treatment were heat-treated in an electric furnace at a prescribed temperature for a prescribed period to remove internal stress from the forged samples and tested for dezincification. The heat treatment was implemented under the conditions of 475° C.×5.0 hrs, for example.

The test for dezincification was carried out by immersing a given test piece in 2.5 ml of an aqueous 1% $CuCl_2$ solution per $mm^2$ of the surface of the test piece exposed to the solution at 75°± 3° C. in the same manner as the ISO-6509 method for dezincification and then measuring the depth of the test piece removed by dezincification.

The results of this test were rated on the three-point scale, wherein the mark "⊙" stands for a depth of removal of not more than 75 μm, the mark "○" for a depth of removal of between 75 and 200 μm and the mark "X" for a depth of removal of not less than 200 μm.

TABLE 3

| Sample Number | Composition (wt %) Cu | Pb | P | Sn | Ni | Ti | Zn | Forge-ability | Resistance to Dezincification |
|---|---|---|---|---|---|---|---|---|---|
| 1 | 58.9 | 2.1 | — | 0.1 | — | — | Balance | ○ | X |
| 2 | 64.2 | 2.1 | 0.09 | 1.2 | — | — | Balance | X | ⊙ |
| 3 | 63.3 | 2.2 | 0.09 | 1.2 | — | — | Balance | X | ⊙ |
| 4 | 62.3 | 2.2 | 0.09 | 1.2 | — | — | Balance | X | ⊙ |
| 5 | 61.0 | 2.3 | 0.09 | — | — | — | Balance | ○ | ○ |
| 6 | 61.1 | 2.3 | — | 1.2 | — | — | Balance | ○ | X |
| 7 | 61.0 | 2.3 | 0.09 | 1.2 | 0.12 | — | Balance | ○ | ⊙ |
| 8 | 60.5 | 2.2 | 0.09 | 1.2 | 0.12 | 0.07 | Balance | ○ | ⊙ |
| 9 | 60.0 | 2.3 | 0.09 | 1.2 | 0.13 | — | Balance | ○ | ⊙ |
| 10 | 60.0 | 2.1 | 0.09 | 1.2 | 0.14 | 0.06 | Balance | ○ | ⊙ |
| 11 | 58.6 | 2.2 | 0.09 | 1.2 | — | — | Balance | ○ | X |
| 12 | 57.8 | 2.3 | 0.09 | 1.2 | — | — | Balance | ○ | X |
| 13 | 57.1 | 2.2 | 0.09 | 1.2 | — | — | Balance | ○ | X |

Sample No. 1 was found to be deficient in resistance to dezincification because it had a low Cu content and contained neither P nor Ni. Samples No. 2 to No. 4 were deficient in hot forgeability because their ratios of the Cu content to the P content were such as to have adverse effects on the hot forgeability. Sample No. 5 was found to be slightly deficient in resistance to dezincification because it contained no Sn. Sample No. 6 was found to be deficient in resistance to dezincification because it contained no P. Samples No. 11 to No. 13 were found to be deficient in resistance to dezincification because they had low Cu contents. Samples No. 7 to No. 10 were found to excel in both hot forgeability and resistance to dezincification.

Figure 9:
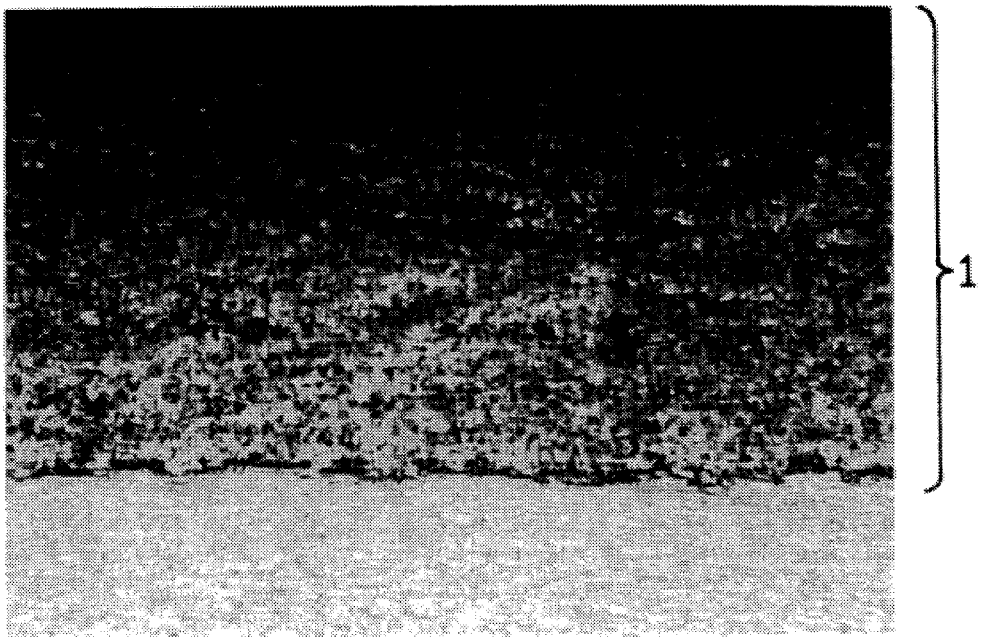
FIG. 9 PRIOR ART
FIG. 9 is a photomicrograph (×50) of a dezincified part of a conventional hot forging grade brass (JIS C3771) obtained in a test by the International Organization for Standard (ISO)-5609 method.

FIG. 9 is a photomicrograph (×50) of a dezincified part formed in a conventional hot forging grade brass (JIS C3771) in a test by the ISO-6509 method. This photomicrograph shows a dezincified part 1 of a depth of about 1,100 μm.

Figure 10:
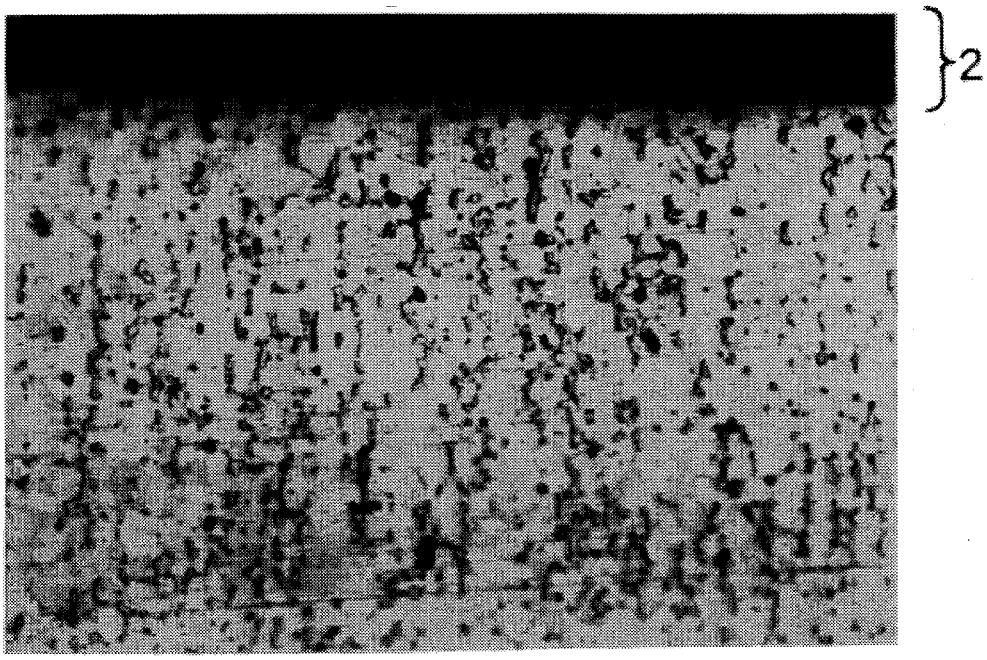
FIG. 10 is a photomicrograph (×200) of a dezincified part of a copper-based alloy according to the first or second aspect of this invention obtained in a test by the ISO-5609 method.

FIG. 10 is a photomicrograph (×200) of a dezincified part formed in a forging grade dezincification-resistant brass of this invention in a test by the ISO-6509 method. This photomicrograph shows a dezincified part 2 of a depth of about 22.5 μm. This depth of dezincification indicates that the brass excelled in resistance to dezincification.

It is evident from the test results given above that the copper-based alloys according to the first and second aspects of this invention will find extensive utility in such machines and parts thereof as stems, valve seats, discs and other valve parts, building materials, electric and machinal parts, ship's parts, hot-water supply devices and other similar hot-water devices, and brine pipes which are liable to encounter the problem of dezincification.

Now, the working examples of the third and fourth aspects of this invention will be cited together with test examples and comparative examples below. In these working examples, machining grade dezincification-resistant brass materials which excel particularly in resistance to corrosion and in machinability as well can be obtained as demonstrated hereinbelow.

Table 4 shows the results of a test for machinability and a test for dezincification.

The samples used in the tests were invariably obtained by extruding a billet 250 mm in diameter into a rod 20 mm in diameter at an extrusion temperature of 700° C., drawing the rod at a cross section-decreasing ratio of 20%, and subsequently heat-treating the drawn rod under the conditions of 450° C.×2.0 hrs for thorough removal of internal stress from the produced sample. The test for machinability was carried out on each sample by a fixed method. The results of this test were rated on the two-point scale, wherein the mark "○" stands for a sample which produced finely divided chips in the cutting treatment and the mark "X" for a sample which produced continued chips.

The test for dezincification was carried out by immersing a given test piece in 2.5 ml of an aqueous 1% $CuCl_2$ solution per $mm^2$ of the surface of the test piece exposed to the solution at 75°±3° C. in the same manner as the ISO-6509 method for dezincification and then measuring the depth of the test piece removed by dezincification. The results of this test were rated on the three-point scale, wherein the mark "Å" stands for a depth of removal of not more than 75 μm, the mark "○" for a depth of removal of between 75 and 200 μm and the mark "X" for a depth of removal of not less than 200 μm.

TABLE 4

| Sample Number | Composition, (wt %) Cu | Pb | P | Ni | Ti | Zn | Machinability | Resistance to Dezincification |
|---|---|---|---|---|---|---|---|---|
| 14 | 59.0 | 3.10 | — | — | — | Balance | ○ | X |
| 15 | 65.0 | 3.08 | 0.09 | — | — | Balance | X | ⊙ |
| 16 | 62.4 | 3.13 | — | — | — | Balance | ○ | X |
| 17 | 62.5 | 3.11 | 0.09 | 0.11 | — | Balance | ○ | ⊙ |
| 18 | 62.0 | 3.11 | 0.09 | 0.10 | 0.05 | Balance | ○ | ⊙ |
| 19 | 62.0 | 3.12 | 0.09 | 0.13 | 0.06 | Balance | ○ | ⊙ |
| 20 | 62.0 | 3.10 | — | — | — | Balance | ○ | X |
| 21 | 60.1 | 3.09 | 0.09 | — | — | Balance | ○ | X |

Figure 11:
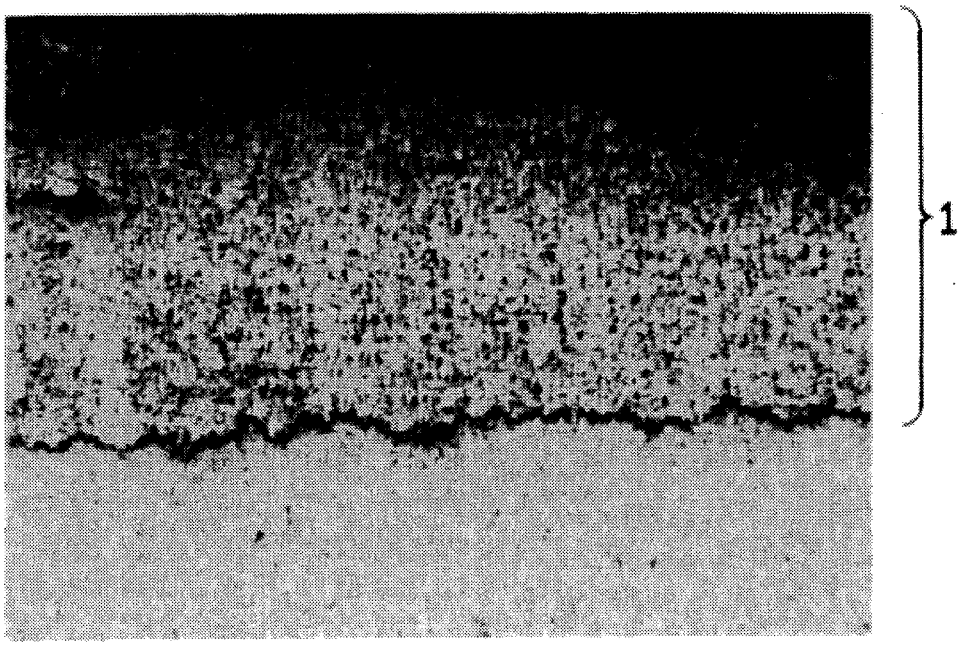
FIG. 11 PRIOR ART
FIG. 11 is a photomicrograph (×50) of a dezincified part of a conventional machining grade brass (JIS C3604) obtained in a test by the ISO-6509 method.

Sample No. 14 indicated in Table 4 was a machining grade brass material of the JIS C3604 type and was found to be deficient in resistance to dezincification because it had a low Cu content and incorporated no P. FIG. 11 is a photomicrograph (×50) of a dezincified part formed in Sample No. 14 in a test by the ISO-6509 method. This photomicrograph shows a dezincified part 1 of a depth of about 1,100 μm. Sample No. 15 was found to be deficient in machinability because it had a large Cu content. Samples No. 16 and No. 20 were found to be deficient in resistance to dezincification because they incorporated no P. Sample No. 21 was found to be deficient in resistance to dezincification because it had a low Cu content.

Figure 12:
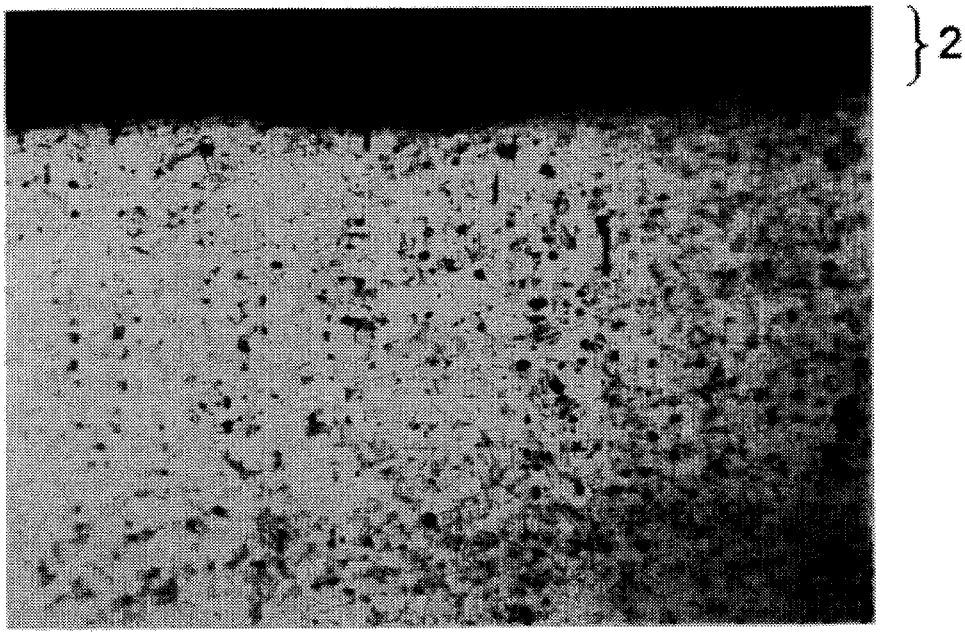
FIG. 12 is a photomicrograph (×200) of a dezincified part of Sample No. 17 or No. 18 according to the third or fourth aspect of this invention obtained in a test by the ISO-6509 method.

Samples No. 17, No. 18 and No. 19 according to this invention were found to excel in machinability and resistance to dezincification. FIG. 12 is a photomicrograph (×200) of a dezincified part formed in Sample No. 17, No. 18 or No. 16 in a test by the ISO-6509 method. This photomicrograph shows a dezincified part 2 of a depth of only about 20 μm. This fact indicates that these samples also excelled in resistance to dezincification.

Figure 13:
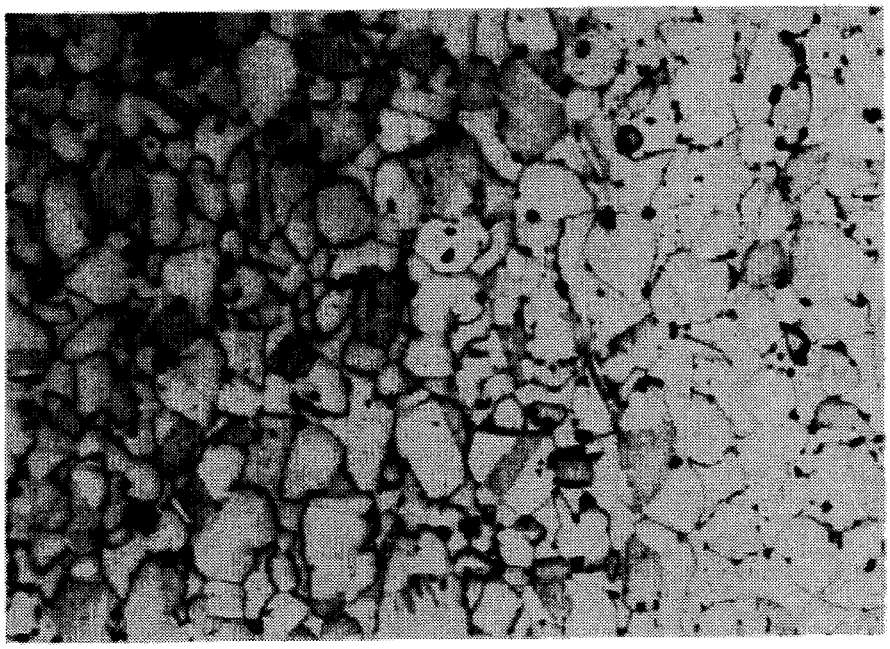
FIG. 13 PRIOR ART
FIG. 13 is a photomicrograph (×200) of the structure of a conventional machining grade brass (JIS C3604).
Figure 14:
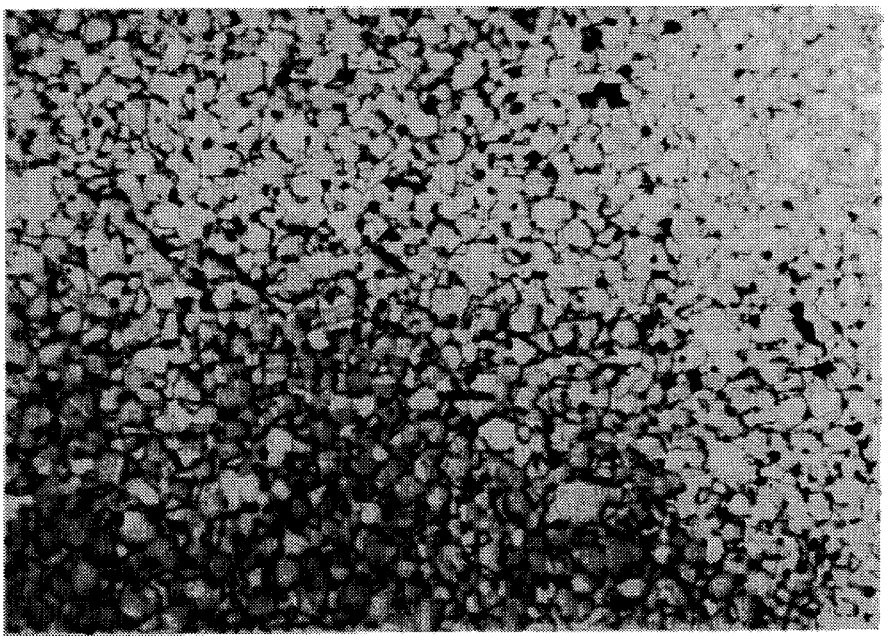
FIG. 14 is a photomicrograph (×200) of the structure of a rod of brass according to the third aspect of this invention.

FIG. 13 is a photomicrograph (×200) of the structure of Sample No. 14, a conventional material, indicated in Table 4. FIG. 14 which is a photomicrograph (×200) of the structure of a rod of brass according to the third aspect of this invention shows that the structure of the ingot was finely divided.

Figure 15:
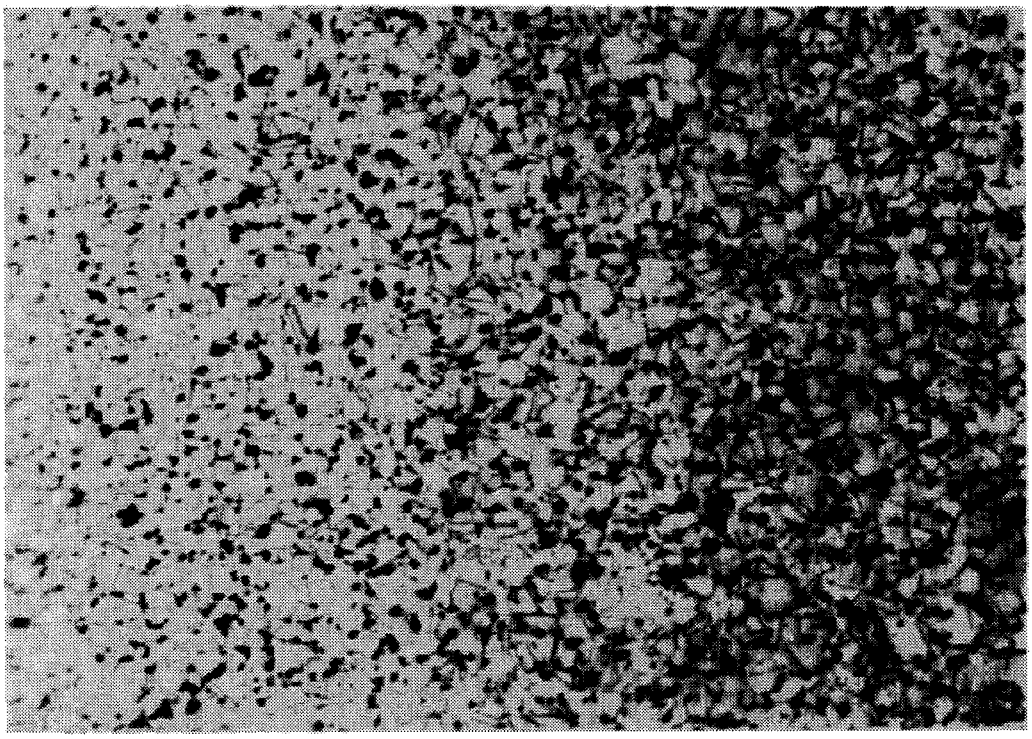
FIG. 15 is a photomicrograph (×200) of the structure of a rod of brass according to the fourth aspect of this invention.

It has been confirmed that in the copper-based alloy according to the fourth aspect of this invention, the addition of 0.05 to 0.30 wt % of Ni and 0.02 to 0.15 wt % of Ti to 61.0 to 63.0 wt % of Cu, 2.0 to 4.5 wt % of Pb, and 0.05 to 0.25 wt % of P contributes to further fine division of the structure of ingot and further exaltation of the resistance to dezincification as shown in the photomicrograph (×200) of a rod of brass of FIG. 15.

It is evident from the test results given above that the copper-based alloys according to the third and fourth aspects of this invention will find extensive utility in such machines and parts thereof as stems, valve seats, discs and other valve parts, building materials, electric and machinal parts, ship's parts, hot-water supply devices and other similar hot-water devices, and brine pipes which are liable to encounter the problem of dezincification.

The first and second aspects of this invention, therefore, permit provision of a copper-based alloy which exhibits the excellent hot forgeability and the excellent resistance to dezincification inherent in a Pb-containing brass and manifests conspicuous merits such as low cost of material and rich economy. The third and the fourth aspect of this invention permit provision of a copper-based alloy which exhibits the excellent machinability and the excellent resistance to dezincification inherent in a Pb-containing brass and manifests conspicuous merits such as low cost of material and rich economy.

What is claimed is:

1. A copper-based alloy having a composition consisting of 59.0 to 62.0 wt % of Cu, 0.5 to 4.5 wt % of Pb, 0.05 to 0.25 wt % of P, 0.5 to 2.0 wt % of Sn, 0.05 to 0.10 wt % of Ni, and the balance of Zn and unavoidable impurities.

2. A copper-based alloy having a composition consisting of 59.0 to 62.0 wt % of Cu, 0.5 to 4.5 wt % of Pb, 0.05 to 0.25 wt % of P, 0.5 to 2.0 wt % of Sn, 0.05 to 0.10 wt % of Ni, 0.02 to 0.08 wt % of Ti, and the balance of Zn and unavoidable impurities and having the an $\alpha+\beta$ structure finely divided uniformly.

3. A copper-based alloy having a composition consisting of 61.0 to 63.0 wt % of Cu, 2.0 to 4.5 wt % of Pb, 0.05 to 0.25 wt % of P, 0.05 to 0.15 wt % of Ni, and the balance of Zn and unavoidable impurities.

4. A copper-based alloy having a composition consisting of 61.0 to 63.0 wt % of Cu, 2.0 to 4.5 wt % of Pb, 0.05 to 0.25 wt % of P, 0.05 to 0.15 wt % of Ni, 0.02 to 0.08 wt % of Ti, and the balance of Zn and unavoidable impurities.

5. A copper-based alloy according to claim 1, wherein the content of Cu is in the range of from 60.5 to 61.5 wt %.

6. A copper-based alloy according to claim 2, wherein the content of Cu is in the range of from 60.5 to 61.5 wt %.

7. A copper-based alloy according to claim 3, wherein the content of Cu is in the range of from 62.2 to 62.6 wt %.

8. A copper-based alloy according to claim 4, wherein the content of Cu is in the range of from 62.2 to 62.6 wt %.

9. A copper-based alloy according to claim 1, wherein the content of Pb is in the range of from 1.6 to 2.4 wt %.

10. A copper-based alloy according to claim 2, wherein the content of Pb is in the range of from 1.6 to 2.4 wt %.

11. A copper-based alloy according to claim 3, wherein the content of Pb is in the range of from 2.1 to 4.2 wt %.

12. A copper-based alloy according to claim 4, wherein the content of Pb is in the range of from 2.1 to 4.2 wt %.

13. A copper-based alloy according to claim 1, wherein the content of is in the range of from 0.07 to 0.10 wt %.

14. A copper-based alloy according to claim 2, wherein the content of P is in the range of from 0.07 to 0.10 wt %.

15. A copper-based alloy according to claim 3, wherein the content of P is in the range of from 0.07 to 0.2 wt %.

16. A copper-based alloy according to claim 4, wherein the content of P is in the range of from 0.07 to 0.2 wt %.

17. A copper-based alloy according to claim 1, wherein the content of Sn is in the range of from 1.0 to 1.5 wt %.

18. A copper-based alloy according to claim 2, wherein the content of Sn is in the range of from 1.0 to 1.5 wt %.

19. A copper-based alloy having a composition consisting of 60.5 to 61.5 wt % of Cu, 1.6 to 2.4 wt % of Pb, 0.07 to 0.10 wt % of P, 1.0 to 1.5 wt % of Sn, 0.05 to 0.10 wt % of Ni, and the balance of Zn and unavoidable impurities.

20. A copper-based alloy having a composition consisting of 60.5 to 61.5 wt % of Cu, 1.6 to 2.4 wt % of Pb, 0.07 to 0.10 wt % of P, 1.0 to 1.5 wt % of Sn, 0.05 to 0.10 wt % of Ni, 0.02 to 0.08 wt % of Ti, and the balance of Zn and unavoidable impurities and having an $\alpha+\beta$ structure finely divided uniformly.

21. A copper-based alloy having a composition consisting of 62.2 to 62.6 wt % of Cu, 2.1 to 4.2 wt % of Pb, 0.07 to 0.2 wt % of P, 0.05 to 0.15 wt % of Ni, and the balance of Zn and unavoidable impurities.

22. A copper-based alloy having a composition consisting of 62.2 to 62.6 wt % of Cu, 2.1 to 4.2 wt % of Pb, 0.07 to 0.2 wt % of P, 0.05 to 0.15 wt % of Ni, 0.02 to 0.08 wt % of Ti, and the balance of Zn and unavoidable impurities.

* * * * *